United States Patent [19]

Kilian

[11] 4,145,949

[45] Mar. 27, 1979

[54] MUSICAL REED

[76] Inventor: Frank A. Kilian, 420 N. Chestnut St., Avalon, Pa. 15202

[21] Appl. No.: 812,486

[22] Filed: Jul. 5, 1977

[51] Int. Cl.[2] ..... G10D 9/02

[52] U.S. Cl. ..... 84/383 A

[58] Field of Search ..... 84/383 A; 428/452, 464

[56] References Cited

U.S. PATENT DOCUMENTS 1,776,566 9/1930 Newton et al. ..... 84/383 A

*Primary Examiner*—L. T. Hix

*Assistant Examiner*—Benjamin R. Fuller

*Attorney, Agent, or Firm*—Webb, Burden, Robinson & Webb

[57] ABSTRACT

A musical instrument reed for woodwinds and the like comprises a cane matrix having top and bottom surfaces. A thin coating comprised of fine particulate matter such as metal powder suspended in a carrier is deposited on the tip section and along the marginal edges of the reed so as to penetrate into the porous matrix. The heart or main vibratory section is not coated.

11 Claims, 7 Drawing Figures

MUSICAL REED

FIELD OF THE INVENTION

My invention relates to musical instrument reeds and, more particularly, to cane reeds for woodwind instruments.

DESCRIPTION OF THE PRIOR ART

It has long been recognized that cane reeds have superior vibratory qualities over the many synthetic reeds which have been developed in an attempt to overcome the inherent shortcomings of a natural wood material such as cane. These shortcomings include the inability of the cane to withstand the moisture present in human saliva. As a result, the reed loses elasticity, swells and the tip section becomes fibrous and unuseable so that the entire reed must be replaced. Further, the marginal edges are feathered so that they too represent an area of premature failure.

However, despite these disadvantages the natural cane reed remains the most satisfactory and the generally accepted type of reed used in high quality, professional performances and the like.

These various known disadvantages have prompted a number of suggestions in the art. These suggestions range from completely substituting synthetic materials for the cane to applying various types of coatings to the cane reeds. Exemplary of such teachings are U.S. Pat. Nos. 3,340,759; 1,790,167; 3,165,963; 3,420,132; 1,783,824; 2,919,617; 3,705,820; 3,267,791; 3,420,132; 2,492,366 and 3,905,268.

SUMMARY OF THE INVENTION

I have now developed a reed which, on the one hand, retains or enhances the excellent vibratory qualities of cane and, on the other hand, has the lasting qualities of a completely synthetic reed. My reed virutally eliminates the premature failure of the cane reed which occurs along the tip or marginal edge portions. In addition, my reed projects better than the average reed in that it is more alive and vibrant and provides loud yet clear sound. In addition, my reed gives reproducible and consistent results from use to use for a given reed and also from reed to reed.

My reed comprises a cane matrix in which the distal tip section and the opposing marginal edges are coated with a thin coating of fine particulate matter such as metal powder suspended in a carrier substance. The heart section of the reed is not coated and the flat side of the reed contains a minimum amount of coating. In a preferred embodiment the coating makes a closed loop about the heart section of the reed on the upper surface and covers only the tip and a part of the marginal edges along the flat surface. A metal insert can be positioned in the heart section to further increase the reed life and assist in the obtention of extremely high notes.

DESCRIPTION OF THE PREFERRED EMBODIMENTS

Figure 1:
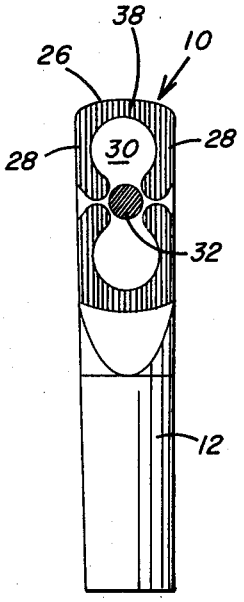
FIG. 1 is a plan view of one side of a reed in accordance with my invention.
Figure 2:
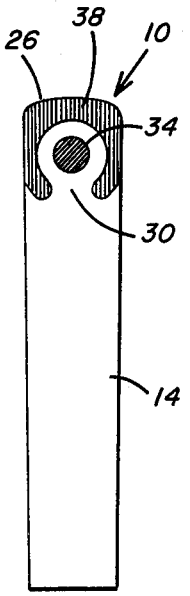
FIG. 2 is a bottom view of the reed of FIG. 1.

My reed, generally designated 10, is the type used for musical woodwind instruments such as the saxophone, clarinet and the like. The reed 10 is made of the natural cane wood which has an inherent porosity to it. This porosity, which collects moisture in the standard reed, is used to advantage in accordance with my invention.

The reed is substantially flat along its underside or bottom surface which is positioned against the mouthpiece (not shown) of the instrument. The exposed or top side as it is referred to hereinafter is generally of a tapered configuration being thinnest at the tip 26 and increasing in arcuate cross section through the heart portion 30 until it reaches a substantially uniform cross section through the remainder of the reed, which uniform cross section is the portion connected to the mouthpiece.

The heart 30 of the reed 10 is that portion of the reed positioned inward of and bounded by the tip 26 and the opposing marginal edges 28, FIGS. 1–7. The heart of the reed extends rearward from the tip and terminates before reaching the portion of the reed which connects to the mouthpiece. The heart 30 forms the active vibratory part of the reed.

I provide a coating made of a fine particulate matter such as metal powder suspended in a carrier substance. This coating is deposited on the reed in a manner that only the tip section and marginal edge sections are covered and the heart section remains uncovered. A minimum amount of coating is applied to the bottom surface so that the flatness is not disrupted. By utilizing very fine metal powder I am able to achieve a penetration of the coating into the porous cane matrix so that the outer surfaces of the reed are only slightly disrupted.

In the drawings I have illustrated several coating configurations which achieve the objectives of my invention. The reed, generally designated 10, of FIGS. 1 and 2 includes an upper surface 12 and bottom surface 14. The coating 38 is placed on the upper surface 12 in the form of a substantially closed loop, FIG. 1, surrounding the heart section 30. Whether or not the loops actually touch or not is a matter of design preference and does not add to or subtract from the present invention. Specifically, the tip 26 and the marginal edges 28 are substantially covered with the coating leaving the cane heart 30 uncoated. Along the bottom surface 14 the coating 38 covers only the tip 26 and a short axial extent along the marginal edges 28. In the reed of FIG. 1, I have also provided a round, thin metal insert 32 positioned in the heart section 30 of the upper surface and another thin metal insert 34 positioned in the heart section 30 of the bottom surface 14 immediately adjacent the tip 26. The metal inserts 32 and 34 permit the player to bite down on the reed so as to achieve a full range of notes without doing physical damage to the reed.

Figure 3:
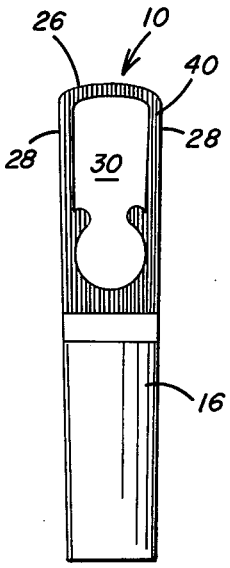
FIG. 3 is a plan view of another embodiment of my invention.
Figure 4:
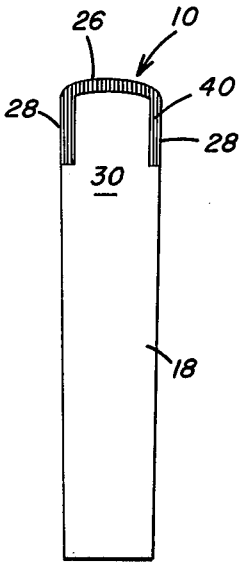
FIG. 4 is a bottom view of the reed of FIG. 3.

The reed 10 of FIGS. 3 and 4 includes a coating 40 having a slightly different configuration. The upper surface 16 of reed 10 includes a coating along the tip 26 and marginal edges 28. The coating 40 makes a closed loop about the heart section so as to maximize the amount of heart 30 which is uncoated in the area of the tip 26. The bottom surface 18 includes coating 40 only along the tip 26 and the section of the marginal edges 28 immediately adjacent to the tip.

Figure 5:
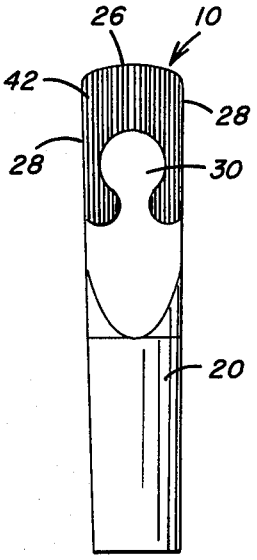
FIG. 5 is a plan view of a further embodiment of my invention.

The reed 10 of FIG. 5 includes a coating 42 which does not form a closed loop on the upper surface 20. Coating 42 is positioned only along the tip 26 and the initial portions of the marginal edges 28 leaving the heart 30 uncoated as well as the remaining portions of the reed 10. The coating 42 is effective on a reed having a long, thin tip section.

Figure 6:
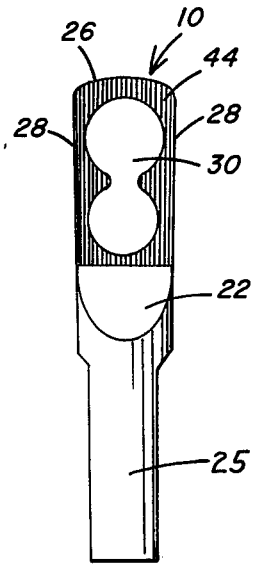
FIG. 6 is a plan view of still another embodiment of my invention.

The reed 10 of FIG. 6 is somewhat similar to the reed of FIG. 1 in that the coating 44 forms a completely closed loop in the form of a FIG. 8 on the upper surface 22. The coating 44 covers all of the tip section 26 and the marginal edge sections 28 about the heart 30. The reed 10 OF FIG. 6 also includes a shank 25 of lesser width than the remainder of the reed. The shank 25 is attached to the mouthpiece (not shown) of the musical instrument. I have found that I am also able to control the tonal qualities of my coated reed by reducing the shank section in the manner illustrated.

Figure 7:
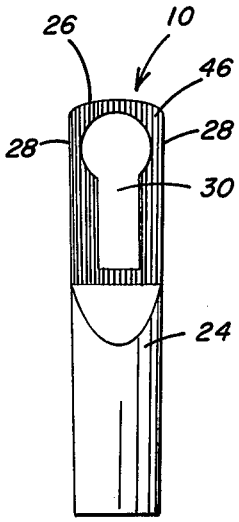
FIG. 7 is a plan view of still a further embodiment of my invention.

The reed 10 of FIG. 7 includes a coating 46 along the tip section 26 and marginal edge sections 28 of the upper surface 24. The coating 46 forms a closed loop to define a keyhole configuration of uncoated reed in the area of the heart section 30.

I have found that metal powders such as aluminum, bronze, gold or copper powder can be successfully incorporated into a coating in which the carrier is a nontoxic enamel base material such as that sold by Sherwin Williams Company under the trade name "Polane". By using only fine metal powders, the coating penetrates into the porous cane matrix thereby only slightly disrupting the exposed surfaces of the reed.

My coating is prepared by thoroughly mixing the particulate metal powder with the carrier substance so as to get a uniform distribution of metal powder therein. The metal powder coating is then brushed on to form the particular configuration desired. The coating is then permitted to dry while applying a slight pressure on the tip and thereafter the reed is cured for approximately two weeks. I have successfully applied coatings to a variety of different cane reeds. Specifically, coated reeds in accordance with my invention have been used by both professional saxophone players and novice learning students. These reeds have lasted appreciably longer than the standard reed through the elimination of the tip end or marginal edges of the cane reed becoming fibrous. In addition, the projection and tonal qualities of my reed have been found to be more than adequate on the professional level of performance.

I claim:

1. A musical instrument reed comprising:

A. a cane matrix having top and bottom surfaces and including a distal tip section, opposing marginal edge sections and a heart section positioned inward of the marginal edge sections and the tip section;

B. a thin coating comprised of fine particulate matter suspended in a carrier substance deposited on at least said tip section and not on said heart section, said coating contained at least partially within said matrix.

2. The reed of claim 1, said coating covering said tip section on both surfaces and said marginal edge sections on said top surface.

3. The reed of claim 1, said coating forming a substantially closed loop about said heart section on said to surface.

4. The reed of claim 3, said coating covering said tip section on said bottom surface.

5. The reed of claim 1, said closed loop being in substantially the form of a FIG. 8.

6. The reed of claim 1, said particulate matter being a metal powder.

7. The reed of claim 6, said metal powder selected from the group consisting of bronze, gold, aluminum and copper.

8. The reed of claim 1, said carrier substance having an enamel base.

9. The reed of claim 1 including a small metal insert embedded in the heart section in equally spaced relationship to said respective marginal edge sections.

10. In a woodwind cane reed having top and bottom surfaces, a distal tip section, opposing marginal edge sections and a heart section bordered by said tip and edge sections, the improvement comprising a thin coating of metal powder suspended in a carrier substance deposited on and contained partially within said reed to cover at least said tip and marginal edge sections of said top surface and said tip section on said bottom surface and not said heart section on either surface.

11. The reed of claim 10 including a shank section for attachment to a mouthpiece, said shank section being of lesser width than the balance of the reed.

* * * * *